US012791268B2

(12) United States Patent
Muska et al.

(10) Patent No.: US 12,791,268 B2
(45) Date of Patent: Nov. 10, 2026

(54) UPPER RECEIVER AND LOWER RECEIVER ASSEMBLY

(71) Applicant: Smith & Wesson Inc., Maryville, TN (US)

(72) Inventors: Simon M. Muska, Enfield, CT (US); Brady Hoddinott, New Hartford, CT (US)

(73) Assignee: SMITH & WESSON INC., Maryville, TN (US)

( * ) Notice: Subject to any disclaimer, the term of this patent is extended or adjusted under 35 U.S.C. 154(b) by 0 days.

(21) Appl. No.: 18/745,207

(22) Filed: Jun. 17, 2024

(65) Prior Publication Data

US 2024/0418462 A1 Dec. 19, 2024

Related U.S. Application Data

(60) Provisional application No. 63/508,304, filed on Jun. 15, 2023.

(51) Int. Cl.
*F41A 3/66* (2006.01)
*F41A 11/02* (2006.01)

(52) U.S. Cl.
CPC ..... *F41A 3/66* (2013.01); *F41A 11/02* (2013.01)

(58) Field of Classification Search
CPC ..... F41A 3/66; F41A 11/00; F41A 11/02
See application file for complete search history.

(56) References Cited

U.S. PATENT DOCUMENTS

| | | | | |
|---|---|---|---|---|
| 227,907 | A | 5/1880 | Livingston | |
| 255,330 | A | 3/1882 | Pierce | |
| 442,453 | A | 12/1890 | Parry | |
| 804,349 | A | 11/1905 | Stendebach | |
| 1,312,170 | A | 8/1919 | Flues | |
| 1,924,656 | A | 8/1933 | Ribe | |
| 4,574,510 | A | 3/1986 | Nishikawa | |
| 9,945,624 | B2 | 4/2018 | Guerini | |
| 11,320,220 | B1 * | 5/2022 | Stephenson | F41A 3/66 |
| 11,435,151 | B2 | 9/2022 | Kincel et al. | |
| 2016/0187086 | A1 * | 6/2016 | Çeler | F41A 15/12 42/6 |

(Continued)

FOREIGN PATENT DOCUMENTS

| | | | |
|---|---|---|---|
| DE | 2841938 | C2 | 12/1988 |
| DE | 4446906 | C1 | 6/1996 |

(Continued)

*Primary Examiner* — Jonathan C Weber
(74) *Attorney, Agent, or Firm* — Ballard Spahr LLP

(57) ABSTRACT

An upper receiver and lower receiver assembly for a firearm. The upper receiver and lower receiver assembly comprises an upper receiver. The upper receiver comprises a body having a rearward end and a first engagement surface proximate to the rearward end. A lower receiver comprises a housing configured to couple with the upper receiver. The housing has a rearward end and a second engagement surface proximate to the rearward end. The second engagement surface defines a recess adapted to receive the first engagement surface to provide an interlocking relationship between the upper and lower receivers. A firearm comprising the upper receiver and lower receiver assembly and a method of assembling the upper receiver and lower receiver assembly are disclosed.

17 Claims, 8 Drawing Sheets

(56) References Cited

U.S. PATENT DOCUMENTS

| | | | | |
|---|---|---|---|---|
| 2018/0087854 | A1* | 3/2018 | Gray | F41A 3/66 |
| 2022/0282942 | A1 | 9/2022 | Kusnierz | |

FOREIGN PATENT DOCUMENTS

| | | | |
|---|---|---|---|
| DE | 19538414 | B4 | 2/2005 |
| DE | 19909580 | B4 | 4/2007 |
| EP | 2040022 | A2 | 3/2009 |
| EP | 2913621 | B1 | 8/2016 |
| FR | 2915275 | B3 | 3/2009 |
| RU | 2031349 | C1 | 3/1995 |
| RU | 2605465 | C1 | 12/2016 |
| WO | 2022/53198 | A1 | 3/2022 |

* cited by examiner

UPPER RECEIVER AND LOWER RECEIVER ASSEMBLY

CROSS REFERENCE TO RELATED APPLICATIONS

This application is based upon and claims benefit of priority to U.S. Provisional Application No. 63/508,304, filed Jun. 15, 2023, which is hereby incorporated by reference herein.

FIELD

This disclosure relates to an upper receiver and lower receiver assembly of a firearm.

BACKGROUND

A firearm, such as a semi-automatic rifle, may have a receiver extension tube assembled to a lower receiver. The receiver extension tube may be coupled to the lower receiver via a screw thread. The receiver extension tube allows a user to attach a stock to the firearm and houses the buffer and bolt assembly. As the buffer and bolt assembly travel rearward to eject the spent cartridge, the rearward end of the receiver extension tube receives a force from the impact from the buffer and bolt assembly. The force from impact may cause deflection and stress on the lower receiver resulting in an undesirable gap between the upper receiver and the lower receiver.

As further disclosed herein, it would be advantageous to improve the receiver assembly of a firearm to limit the deflection and stress on the lower receiver and to divide the impact load across multiple components of the firearm.

SUMMARY

An example upper receiver and lower receiver assembly for a firearm according to the disclosure includes an upper receiver. The upper receiver includes a body having a rearward end and a first engagement surface proximate to the rearward end. A lower receiver includes a housing configured to couple with the upper receiver. The housing has a rearward end and a second engagement surface proximate to the rearward end. The second engagement surface defines a recess adapted to receive the first engagement surface to provide an interlocking relationship between the upper and lower receivers.

In an example embodiment, the first engagement surface is positioned inwardly of an exterior surface of the body of the upper receiver, and the second engagement surface is positioned inwardly of an exterior surface of the housing of the lower receiver.

In an example embodiment, the first engagement surface includes at least one projection.

In an example embodiment, the second engagement surface includes at least one notch. Each notch of the at least one notch is configured to receive a respective projection of the at least one projection.

In an example embodiment, the first engagement surface further includes a first sidewall and the second engagement surface further includes a second sidewall. The respective projection may be integrally formed with the first sidewall, and the notch configured to receive the respective projection may be defined within the second sidewall.

In an example embodiment, the respective projection includes a first locking surface and the notch configured to receive the respective projection includes a second locking surface.

In an example embodiment, the first locking surface is a forward surface of the respective projection and the second locking surface is a forward surface of the notch configured to receive the respective projection.

In an example embodiment, each respective projection and notch configured to receive the respective projection are configured to interlock in a close clearance condition. The close clearance condition allows the lower receiver to pivot relative to the upper receiver until a surface of the respective projection contacts a surface of the notch that receives the respective projection.

In an example embodiment, the exterior surface of the body of the upper receiver is aligned with the exterior surface of the housing of the lower receiver when the each respective projection and notch are interlocked.

In an example embodiment, the rearward end of the housing is configured to receive a receiver extension tube.

In an example embodiment, the notch of the at least one notch and the respective projection of the at least one projection are at least partially above a centerline of the receiver extension tube when each respective projection and notch are interlocked.

In an example embodiment, the at least one projection includes a first projection and a second projection, and the at least one notch includes a first notch and a second notch that are each configured to receive a respective one of the first projection and the second projection.

In an example embodiment, the first projection and the second projection are positioned symmetrically with respect to a vertical plane containing a central longitudinal axis of the upper receiver. The first notch and the second notch are positioned symmetrically with respect to a vertical plane containing a central longitudinal axis of the lower receiver.

In an example embodiment, a lower surface proximate to the rearward end of the body of the upper receiver is complementary to an upper surface proximate to the rearward end of the housing of the lower receiver.

The disclosure further encompasses a firearm. The firearm includes a barrel, a stock, and a firing mechanism. The firearm includes an upper receiver and lower receiver assembly, as disclosed herein, configured to connect to the barrel, the stock, and the firing mechanism.

The disclosure further encompasses a method of assembling an upper receiver and lower receiver assembly for a firearm. The method includes aligning an upper receiver and a lower receiver. The upper receiver includes a body having a rearward end and a first engagement surface proximate to the rearward end. The lower receiver includes a housing having a rearward end and a second engagement surface proximate to the rearward end. The method further includes coupling the upper receiver to the lower receiver by inserting the first engagement surface into a recess defined by the second engagement surface. The first and second engagement surfaces provide an interlocking relationship between the upper and lower receivers.

In an example embodiment, the first engagement surface includes at least one projection integrally formed with a first sidewall and the second engagement surface comprises at least one notch defined within a second sidewall. The upper receiver and the lower receiver are coupled by inserting each projection of the at least one projection into a respective notch of the at least one notch.

DETAILED DESCRIPTION

Figure 1:
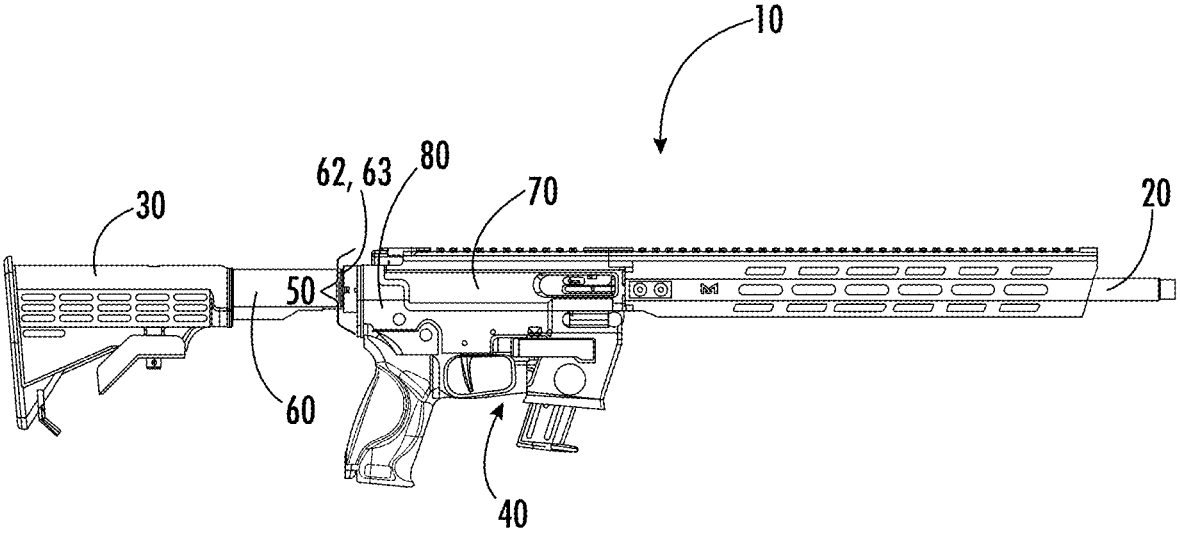
FIG. 1 is a side view of an example firearm as disclosed herein.

FIG. 1 shows a firearm 10, in this example a semi-automatic rifle. Although depicted in the drawings as a semi-automatic rifle, it is contemplated that other firearm designs and configurations can be compatible with the current disclosure. The firearm 10 comprises a barrel 20, a stock 30, and a firing mechanism 40 configured to connect to an upper receiver and lower receiver assembly 50. Optionally, the firing mechanism 40 comprises a trigger and components for the action such as lever action, pump action, bolt action, or semi-automatic. In this example, the stock 30 is configured to connect to the upper receiver and lower receiver assembly 50 via a receiver extension tube 60. A forward end 62 of the receiver extension tube 60 may be configured to connect to the upper receiver and lower receiver assembly 50 via screw threads 63.

Figure 2:
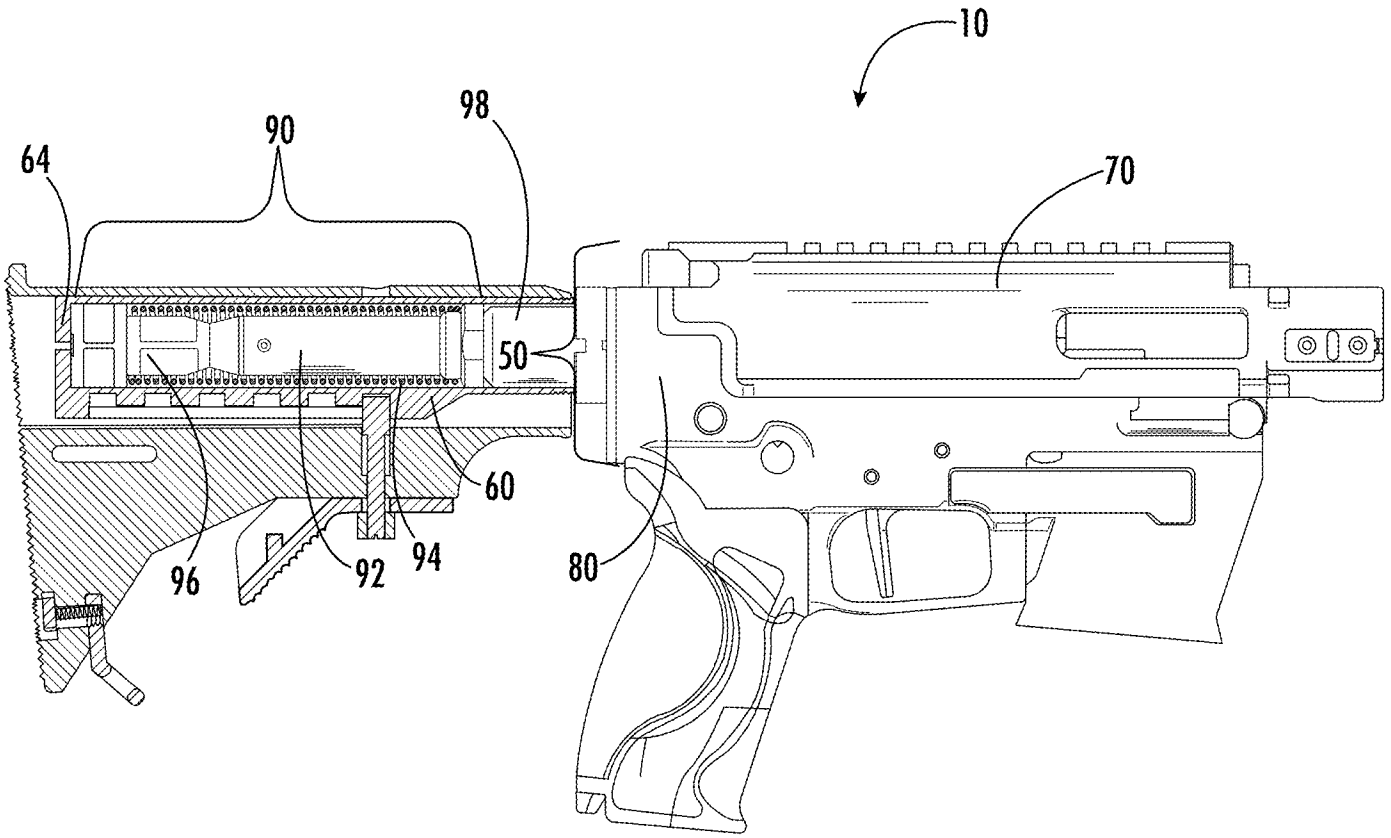
FIG. 2 is a side view of the example firearm shown in FIG. 1 with the receiver extension tube and stock shown in a side section view.

As shown in FIG. 2, the receiver extension tube 60 may enclose a buffer assembly 90. The buffer assembly 90 may include a buffer 92 and a buffer stop 96. In this example, the buffer stop 96 may abut or be coupled to a rearward end 64 of the receiver extension tube 60. The buffer 92 may be coupled to a bolt assembly 98. When the trigger of the firearm 10 is pulled, expanding gases in the chamber of the firearm 10 force a loaded projectile out of the barrel 20 of the firearm 10 while forcing the cartridge towards the rearward end 64 of the receiver extension tube 60 to be ejected from the firearm 10. As the cartridge moves rearward, it drives the bolt assembly 98 and the buffer 92 to the rearward end 64 of the receiver extension tube 60, compressing the return spring 94. The buffer 92 impacts the buffer stop 96 when the bolt assembly 98 reaches its maximum rearward travel. After the bolt assembly 98 reaches its maximum rearward travel position, the stored energy of the compressed return spring 94 expands the return spring 94 to drive the bolt assembly 98 back into battery, stripping and chambering a new round from the magazine. The repetitive impact from the buffer 92 on buffer stop 96 results in an impact force on the rearward end 64 of the receiver extension tube 60 which transfers to the lower receiver 80.

Figure 3:
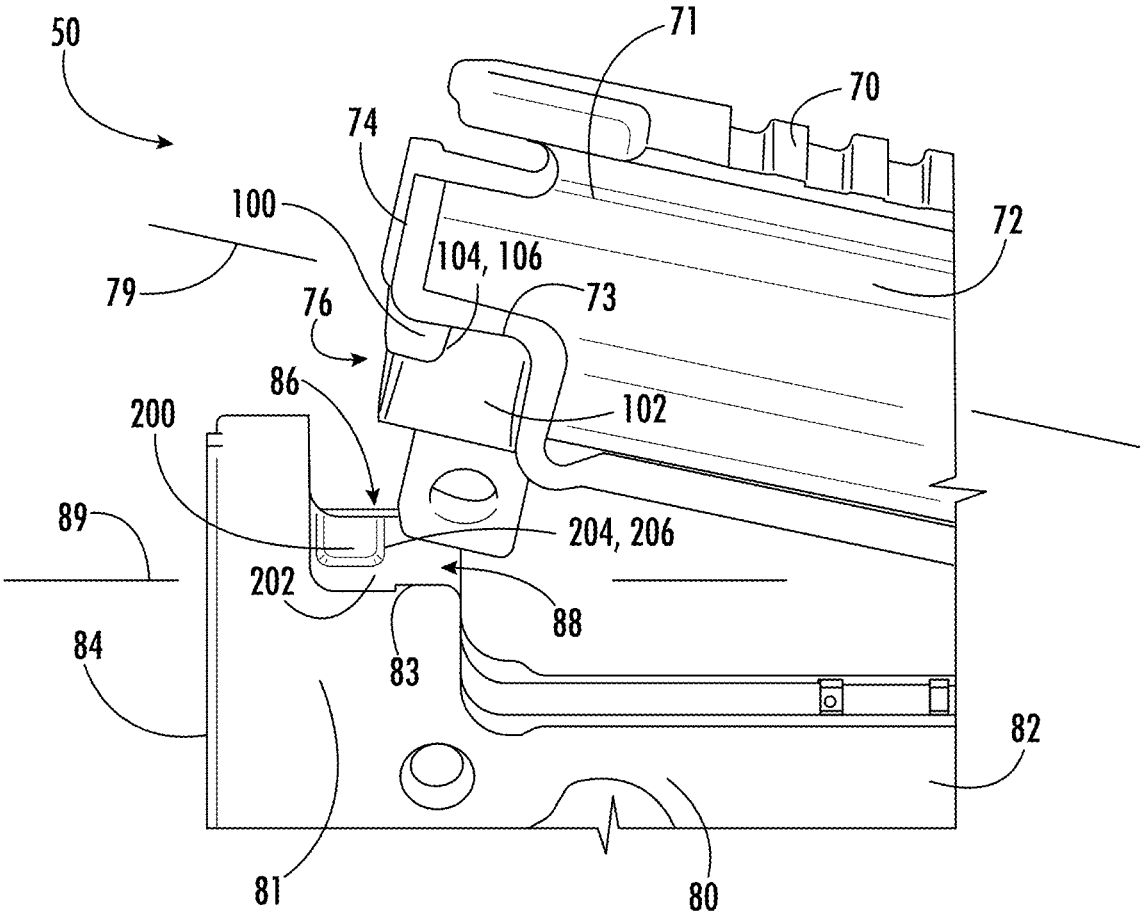
FIG. 3 shows a side perspective view of part of the upper receiver and lower receiver of the example firearm.
Figure 4:
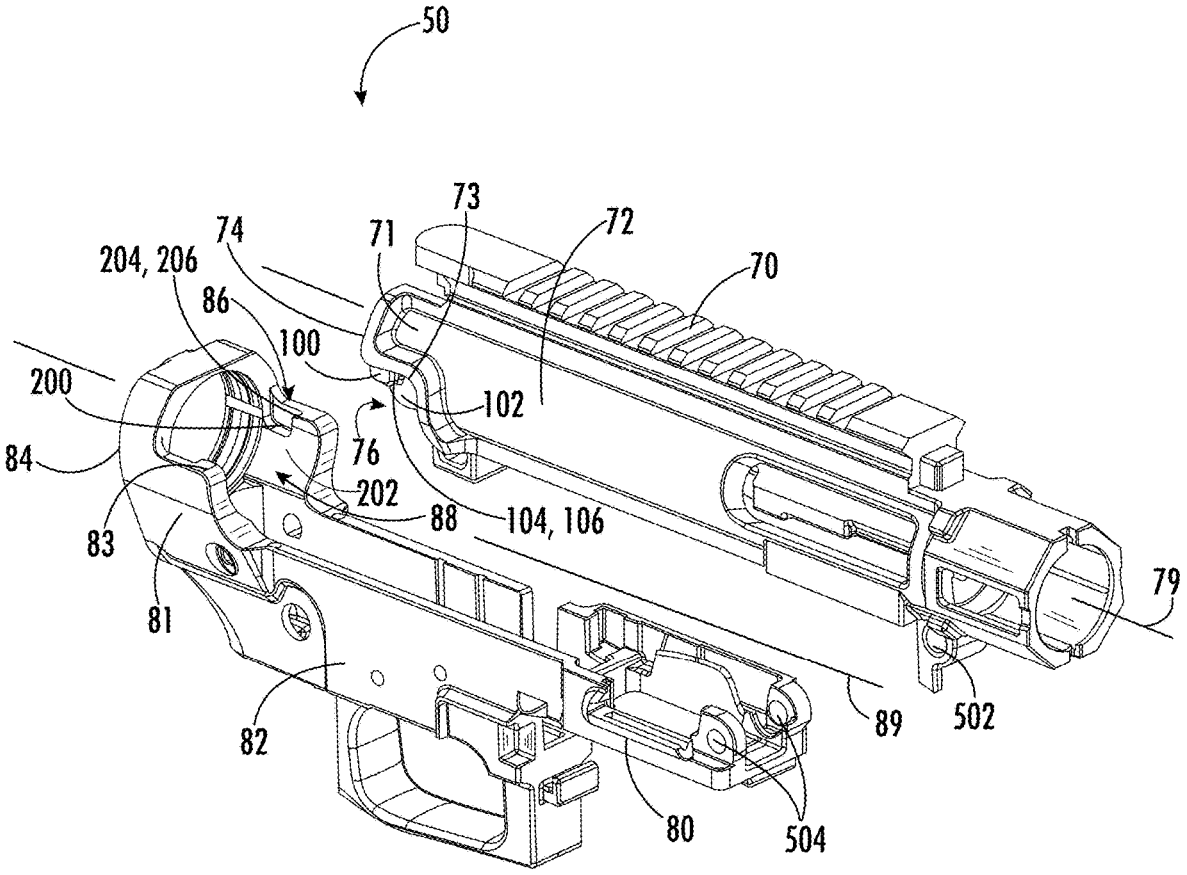
FIG. 4 shows a front right perspective view of the upper receiver and lower receiver of the example firearm.
Figure 5:
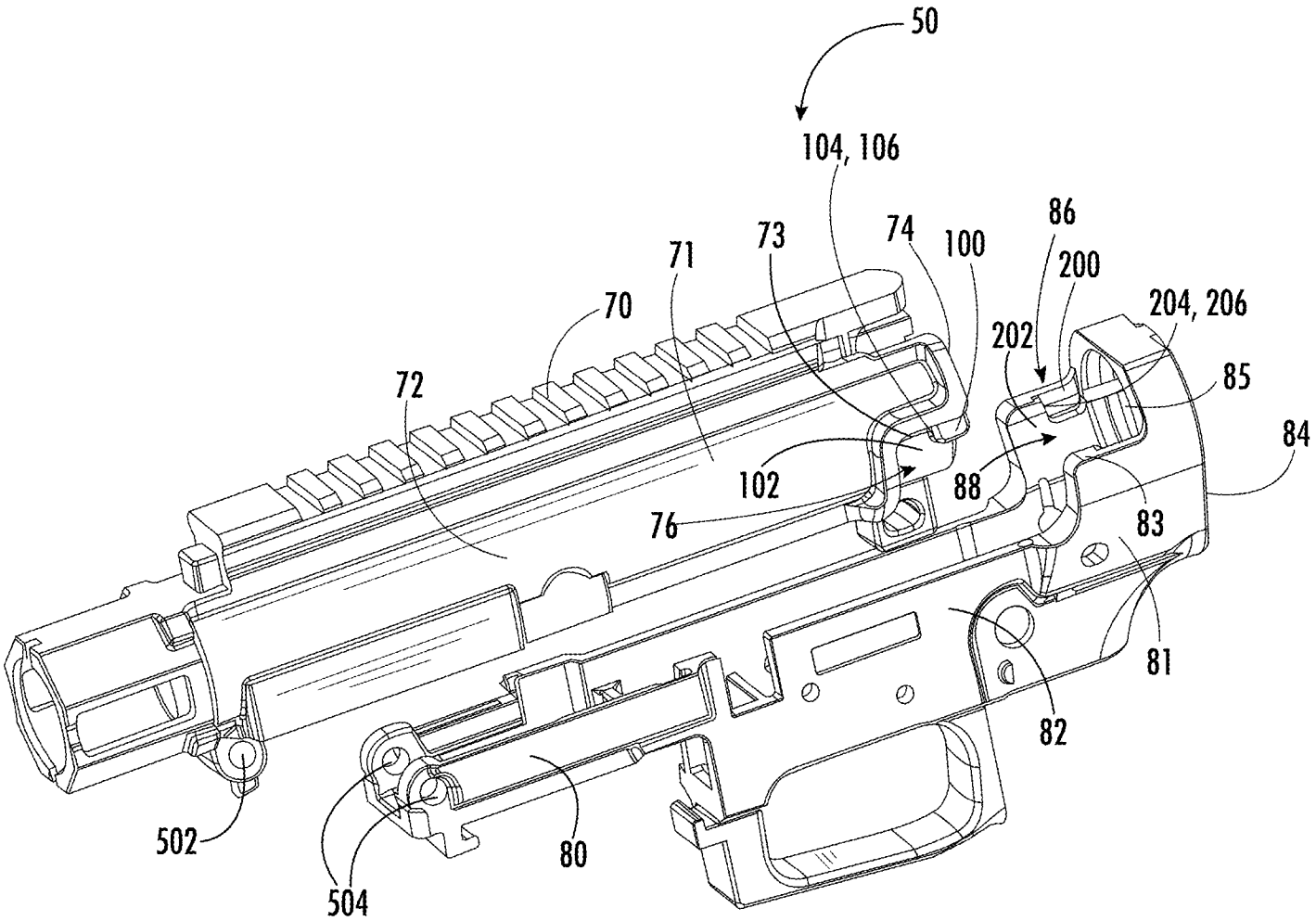
FIG. 5 shows a front left perspective view of the upper receiver and lower receiver of the example firearm.
Figure 6:
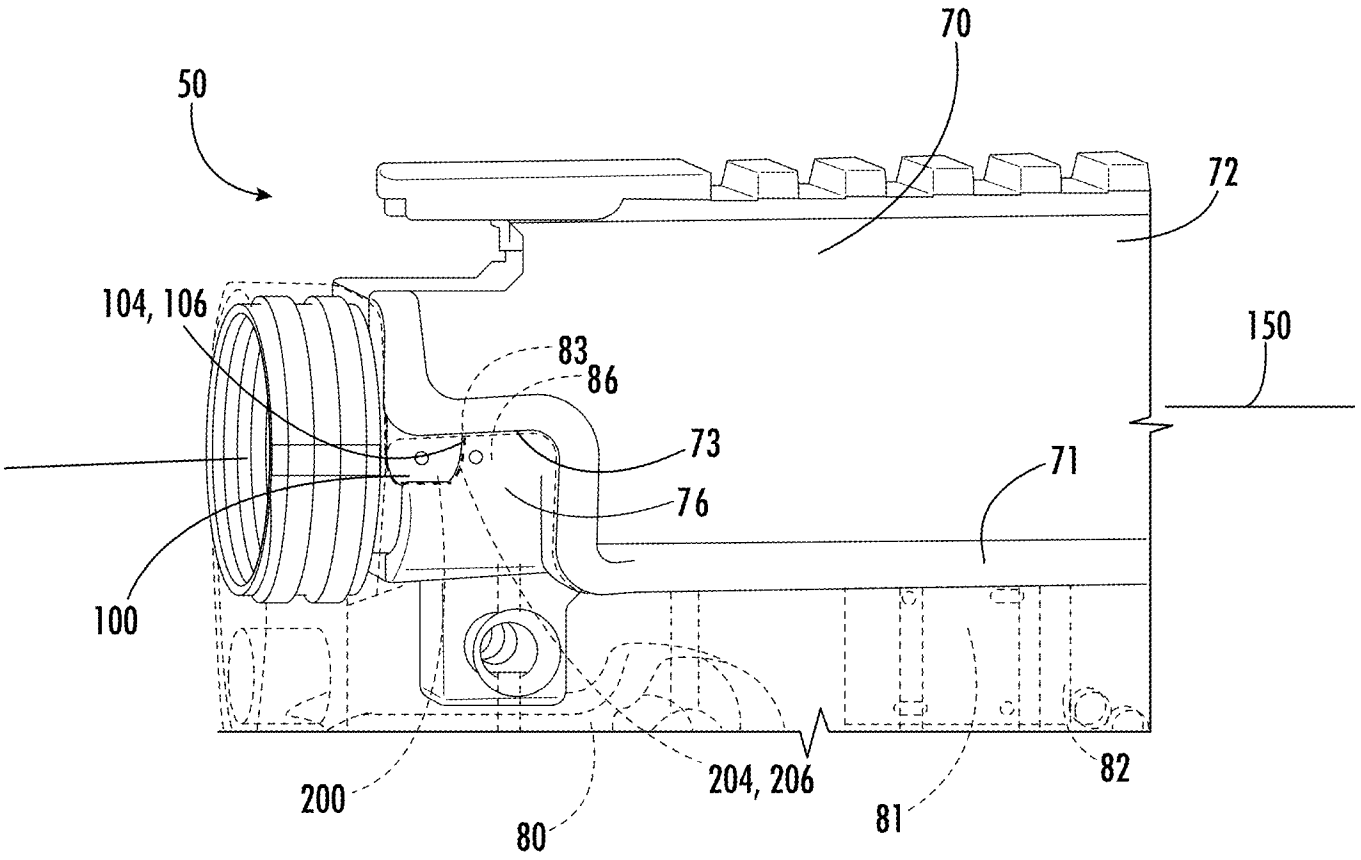
FIG. 6 shows a side view of the assembled upper receiver and lower receiver of the example firearm with the lower receiver shown transparently and underlying features shown in solid line.

As shown in FIGS. 3-5, the upper receiver and lower receiver assembly 50 comprises an upper receiver 70 and a lower receiver 80. The upper receiver 70 comprises a body 72 having a rearward end 74. The lower receiver 80 comprises a housing 82 configured to couple with the upper receiver 70. The housing 82 has a rearward end 84. The rearward end 84 of the housing 82 may be configured to receive the receiver extension tube 60 (shown in FIGS. 1 and 2). In this example, the rearward end 84 of the housing 82 includes threads 85 to allow the screw threads 63 of the forward end 62 of the receiver extension tube 60 to screw into the rearward end of the housing to connect the upper receiver and lower receiver assembly 50 to the receiver extension tube 60. A lower surface 73 proximate to the rearward end 74 of the body 72 of the upper receiver 70 may be complementary to an upper surface 83 proximate to the rearward end 84 of the housing 82 of the lower receiver 80. As shown in FIG. 6, the lower surface 73 of the body 72 may abut the upper surface 83 of the housing 82 when the upper receiver 70 and lower receiver 80 are coupled.

As shown in FIGS. 3-5, the body 72 of the upper receiver 70 further comprises a first engagement surface 76 proximate to the rearward end 74. The first engagement surface 76 may be positioned inwardly of an exterior surface 71 of the body 72 of the upper receiver 70. The housing 82 of the lower receiver 80 further comprises a second engagement surface 86 proximate to the rearward end 84. The second engagement surface 86 may be positioned inwardly of an exterior surface 81 of the housing 82 of the lower receiver 80. The second engagement surface 86 defines a recess 88 adapted to receive the first engagement surface 76 to provide an interlocking relationship between the upper receiver 70 and the lower receiver 80. As shown in FIG. 6, the upper receiver 70 and lower receiver 80 may interlock via the first engagement surface 76 and the second engagement surface 86 to provide reinforcement to limit deflection of the lower receiver 80 and divide the impact force across the upper receiver 70 and lower receiver 80 when the buffer 92 impacts the rearward end 64 of the receiver extension tube 60, or in this example, the buffer stop 96. Optionally, the first engagement surface 76 and the second engagement surface 86 may be produced out of the bulk material of the upper receiver 70 and the lower receiver 80, respectively. In one aspect, the material may be a polymer. Alternatively, the first engagement surface 76 and the second engagement surface 86 may be produced separately and subsequently insert molded into the upper receiver 70 and the lower receiver 80. In one aspect, the first engagement surface 76 and the second engagement surface 86 may be produced from metal.

As shown in FIGS. 3-5, the first engagement surface 76 may comprise at least one projection 100. Each projection 100 may project downwardly from the lower surface 73. In this example, the first engagement surface 76 comprises two projections 100. The two projections 100 may be positioned symmetrically with respect to a vertical plane containing a central longitudinal axis 79 of the upper receiver 70. The first engagement surface 76 may further comprise a first sidewall 102. The first sidewall 102 may abut or be integrally formed with the body 72 of the upper receiver 70. Each projection 100 may be integrally formed with the first sidewall 102. Each projection 100 may project outwardly from the first sidewall 102. The second engagement surface 86 may comprise at least one notch 200. Each notch 200 may extend upwardly toward the upper surface 83. Each notch 200 may be configured to receive a respective projection 100 to interlock the upper receiver 70 and lower receiver 80. In this example, the second engagement surface 86 comprises two notches 200, and each notch 200 may be configured to receive a respective projection 100. The two notches 200 may be positioned symmetrically with respect to a vertical plane containing a central longitudinal axis 89 of the lower receiver 80. The second engagement surface 86 may further comprise a second sidewall 202. The second sidewall 202 may abut or be integrally formed with the housing 82 of the lower receiver 80. Each notch 200 may be defined within the second sidewall 202. Each notch 200 may extend into the second sidewall 202. The first sidewall 102 and the second sidewall 202 may strengthen the interlocking connection of the first engagement surface 76 and the second engagement surface 86. Without the first sidewall 102 and the second sidewall 202, the interlocking connection is loaded in bending rather than shear.

Figure 7:
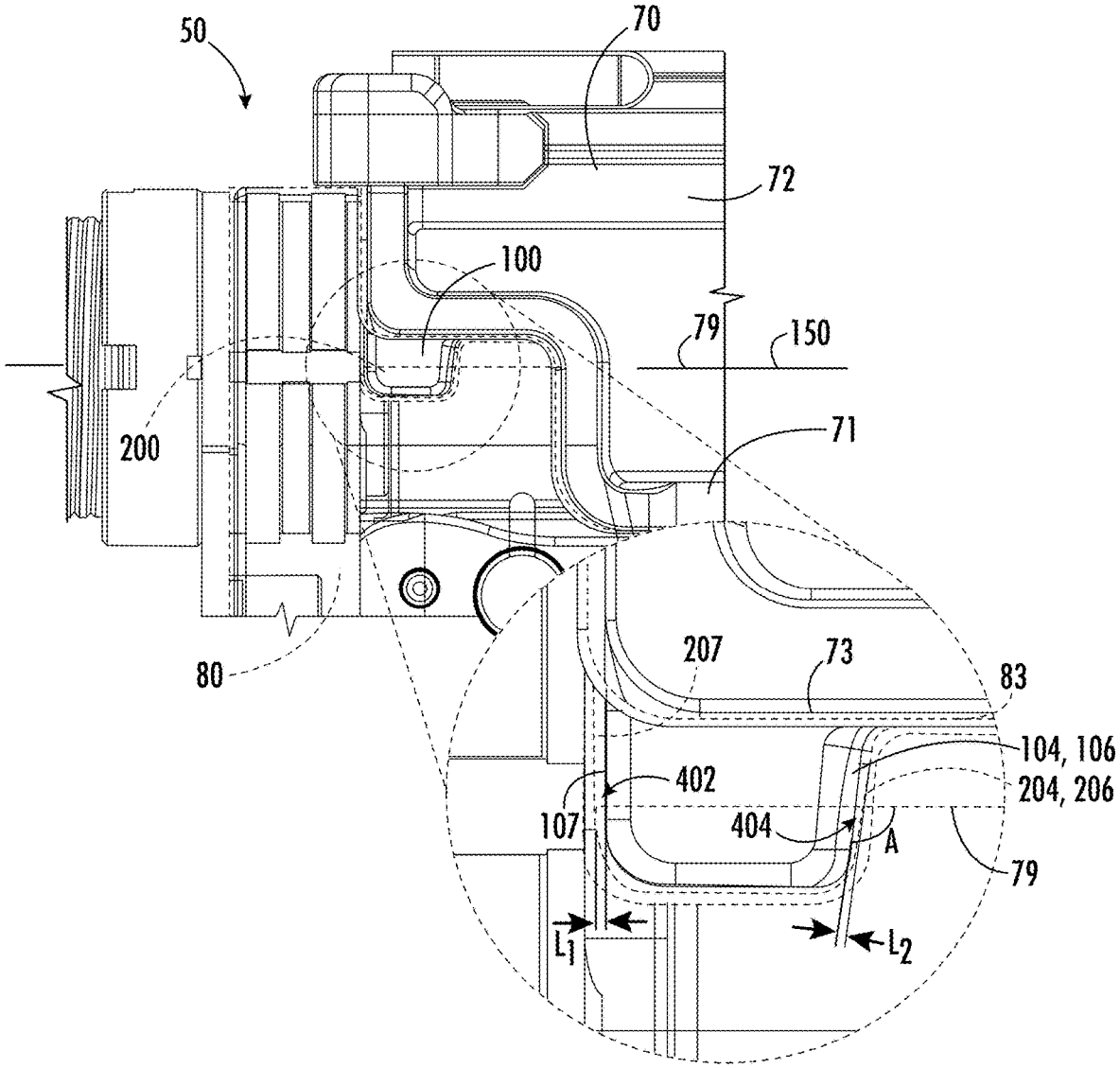
FIG. 7 shows a side view of the assembled upper receiver and lower receiver of the example firearm with the lower receiver shown transparently and underlying features shown in solid line.

Each projection 100 may comprise a first locking surface 104. Each notch 200 may comprise a second locking surface 204. As shown in FIGS. 6 and 7, the first locking surface 104 of a projection 100 may abut the second locking surface 204 of a notch 200 to interlock the upper receiver 70 and the lower receiver 80. In this example, the first locking surface 104 is a forward surface 106 of the projection 100, and the second locking surface 204 is a forward surface 206 of the notch 200. The forward surfaces 106, 206 may be angular, convex or concave. As shown in FIG. 7, the forward surfaces 106, 206 may extend downwardly from the lower surface 73 and upper surface 83, respectively, at an angle A with respect to the longitudinal axis 79 of the upper receiver 70. In one aspect the angle may be greater than 90 degrees with respect to the longitudinal axis. In one aspect the angle may be less than 90 degrees. The angle A of the forward surfaces 106, 206 may allow proper engagement and disengagement of the upper receiver 70 and lower receiver 80. The angle A of the forward surface 106, 206 may allow movement of the lower receiver 80 relative to the upper receiver 70 and provide structural support during the dynamic conditions while discharging and reloading the firearm. Each projection 100 and notch 200 may each comprise a rearward surface 107, 207 oppositely disposed the forward surfaces 106, 206.

Figure 8:
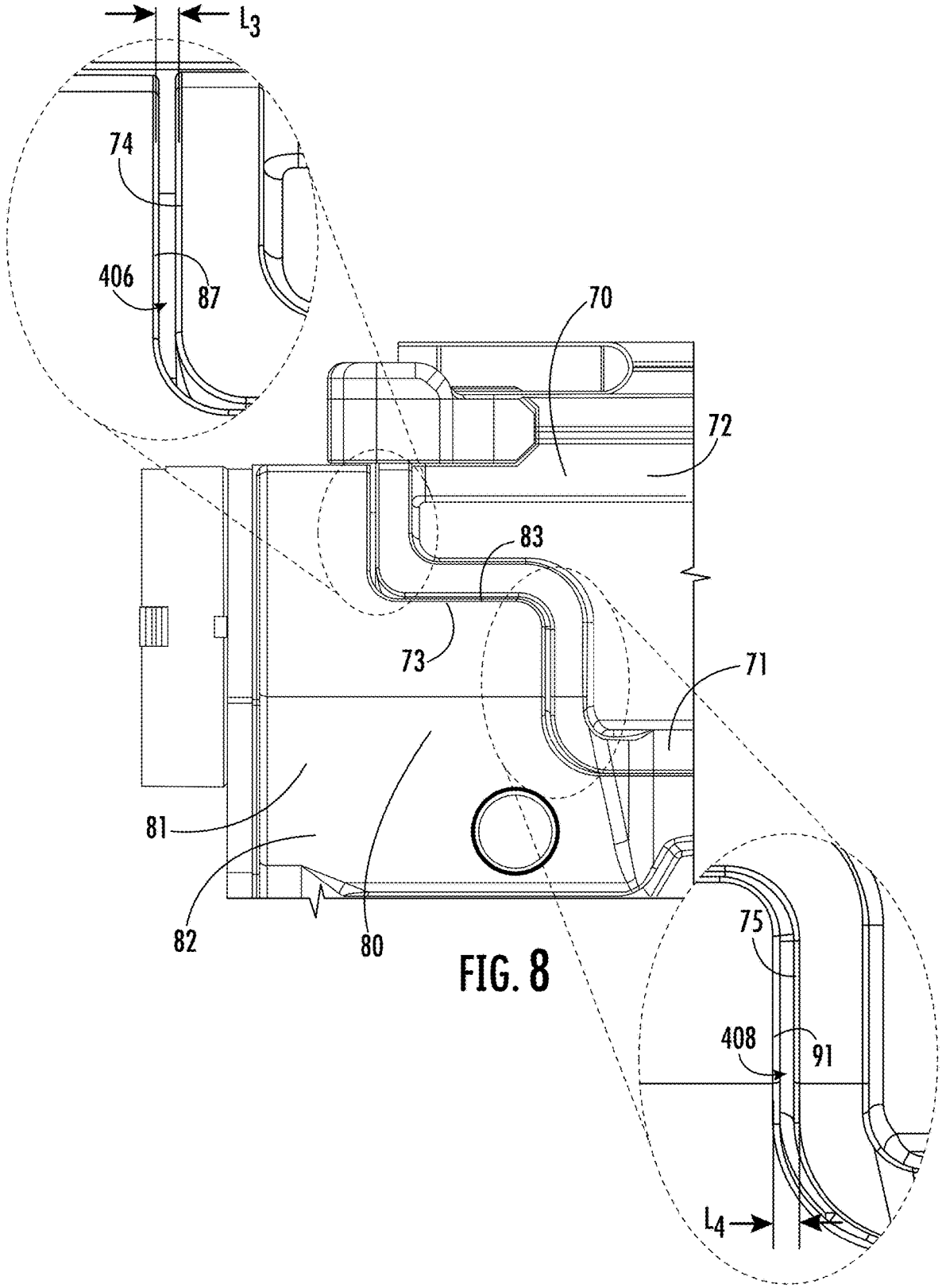
FIG. 8 shows a side view of the assembled upper receiver and lower receiver of the example firearm.

Each respective projection 100 and notch 200 may be configured to interlock in a close clearance condition. A close clearance condition may allow the lower receiver 80 to pivot relative to the upper receiver 70 about a pivot pin (not shown) extending through aligned openings 502, 504 in the upper receiver 70 and lower receiver 80 (shown in FIGS. 4 and 5) while preventing permanent deformation of the lower receiver 80. As shown in FIGS. 7 and 8, in the close clearance condition, when the firearm is at rest and is not being discharged, there may be a first gap 402 between the rearward surfaces 107, 207 of the projection 100 and notch 200 having a first length $L_1$, a second gap 404 between the forward surfaces 106, 206 of the projection 100 and notch 200 having a second length $L_2$, a third gap 406 between the rearward end 74 of the upper receiver 70 and a first vertical exterior surface 87 of the lower receiver 80 having a third length $L_3$, and a fourth gap 408 between a surface 75 of the upper receiver 70 adjacent the first sidewall 102 (shown in FIGS. 3-5) and a second vertical exterior surface 91 of the lower receiver 80 having a fourth length $L_4$. The gaps 402, 404, 406, 408 and their respective lengths $L_1$, $L_2$, $L_3$, $L_4$ may allow for proper assembly and engagement of the upper receiver 70 and lower receiver 80. The second gap 404 and its respective length $L_2$ may allow the gap 404 to close and the adjacent surfaces 106, 206 to abut when the lower receiver 80 pivots during discharge of the firearm 10 thereby reducing the deflection of the lower receiver 80 from impact forces on the rearward end 64 of the receiver extension tube 60 by dividing the resulting load across at least the lower receiver 80 and the upper receiver 70. For example, during discharge, the second gap 404 may close and the adjacent surfaces 106, 206 abut to transfer the load from the lower receiver 80 to the upper receiver 70.

As shown in FIGS. 6 and 8, when each respective projection 100 and notch 200 are interlocked, the exterior surface 71 of the body 72 of the upper receiver 70 may be aligned with the exterior surface 81 of the housing 82 of the lower receiver 80. Each interlocked projection 100 and notch 200 may be positioned at least partially above a centerline 150 of the receiver extension tube 60 to more effectively control the load on the lower receiver 80 from the impact force and reduce the resulting deflection of the lower receiver 80. The centerline 150 may be aligned with the central longitudinal axis 79 of the upper receiver 70.

As shown in FIGS. 6-8, the upper receiver and lower receiver assembly 50 is assembled by aligning the upper receiver 70 and the lower receiver 80. The upper receiver 70 is coupled to the lower receiver 80 by inserting the first engagement surface 76 into the recess 88 defined by the second engagement surface 86 to provide an interlocking relationship between the upper receiver 70 and the lower receiver 80. In this example, the upper receiver 70 and the lower receiver 80 are coupled by inserting each projection 100 into a respective notch 200.

It is expected that the example upper receiver and lower receiver assembly 50 according to the disclosure will reduce the deflection of the lower receiver 80 from impact forces on the rearward end 64 of the receiver extension tube 60 by dividing the resulting load across at least the upper receiver 70 and the lower receiver 80.

All of the embodiments of the claimed invention described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

What is claimed is:

1. A method of assembling an upper receiver and lower receiver assembly for a firearm, said method comprising:

aligning an upper receiver and a lower receiver, said upper receiver comprising a body having a rearward end and a first engagement surface proximate to said rearward end, said first engagement surface comprising at least one projection, wherein each projection of said at least one projection comprises a forward surface, said lower receiver comprising a housing having a rearward end and a second engagement surface proximate to said rearward end, said second engagement surface comprising at least one notch, wherein each notch of said at least one notch comprises a forward surface; and coupling said upper receiver to said lower receiver by inserting said first engagement surface into a recess defined by said second engagement surface and by inserting each projection of said at least one projection into a respective notch of said at least one notch to interlock in a close clearance condition, wherein, when said upper receiver and said lower receiver are assembled in said close clearance condition, said assembly further comprises a gap between each said forward surface of said at least one notch and said forward surface of said respective projection, wherein said first and second engagement surfaces provide an interlocking relationship between said upper and lower receivers, wherein said close clearance condition allows said lower receiver to pivot relative to said upper receiver until a surface of said respective projection contacts a surface of said notch that receives said respective projection, wherein during discharge of said firearm, said gap is configured to close, such that each said forward surface of said at least one notch contacts said forward surface of said respective projection.

2. The method according to claim 1, wherein said first engagement surface comprises at least one projection integrally formed with a first sidewall and said second engagement surface comprises at least one notch defined within a second sidewall, wherein said upper receiver and said lower receiver are coupled by inserting each projection of said at least one projection into a respective notch of said at least one notch.

3. An upper receiver and lower receiver assembly for a firearm, said assembly comprising:

an upper receiver comprising a body having a rearward end and a first engagement surface proximate to said rearward end, said first engagement surface comprising at least one projection, wherein each projection of said at least one projection comprises a forward surface; and a lower receiver comprising a housing configured to couple with said upper receiver, said housing having a rearward end and a second engagement surface proximate to said rearward end, said second engagement surface defining a recess adapted to receive said first engagement surface to provide an interlocking relationship between said upper and lower receivers, said second engagement surface comprising at least one notch, wherein each notch of said at least one notch comprises a forward surface, wherein each notch of said at least one notch is configured to receive a respective projection of said at least one projection;

wherein each respective projection and notch configured to receive said respective projection are configured to interlock in a close clearance condition, wherein, when said upper receiver and said lower receiver are assembled in said close clearance condition, said assembly further comprises a gap between each said forward surface of said at least one notch and said forward surface of said respective projection, wherein during discharge of said firearm, said gap is configured to close, such that each said forward surface of said at least one notch contacts said forward surface of said respective projection.

4. The assembly according to claim 3, wherein said lower receiver comprises a polymer.

5. A firearm, said firearm comprising:

said assembly according to claim 3;

a barrel;

a stock; and a firing mechanism, wherein said assembly is connected to said barrel, said stock, and said firing mechanism.

6. The firearm according to claim 5, wherein said lower receiver comprises a polymer.

7. The assembly according to claim 3, wherein said at least one projection comprises a first projection and a second projection, and wherein said at least one notch comprises a first notch and a second notch that are each configured to receive a respective one of the first projection and the second projection.

8. The assembly according to claim 3, wherein each notch of said at least one notch comprises a rearward surface and each projection of said at least one projection comprises a rearward surface, wherein, in said close clearance condition, said assembly further comprises a gap between said rearward surface of said notch and said rearward surface of said projection.

9. The assembly according to claim 3, wherein said first engagement surface is positioned inwardly of an exterior surface of said body of said upper receiver, and wherein said second engagement surface is positioned inwardly of an exterior surface of said housing of said lower receiver.

10. The assembly according to claim 3, wherein said first engagement surface further comprises a first sidewall and said second engagement surface further comprises a second sidewall, wherein said respective projection is integrally formed with said first sidewall, and said notch configured to receive said respective projection is defined within said second sidewall.

11. The assembly according to claim 3, wherein said respective projection comprises a first locking surface and said notch configured to receive said respective projection comprises a second locking surface.

12. The assembly according to claim 11, wherein said first locking surface is said forward surface of said respective projection and said second locking surface is said forward surface of said notch configured to receive said respective projection.

13. The assembly according to claim 3, wherein said upper receiver has a central longitudinal axis, wherein each projection of said at least one projection is at least partially positioned above a first plane, wherein said first plane contains said central longitudinal axis and is perpendicular to a vertical plane containing said central longitudinal axis.

14. The assembly according to claim 13, wherein each respective projection and notch configured to receive said respective projection are configured to interlock in said close clearance condition such that said notch is at least partially positioned above the first plane.

15. A firearm, said firearm comprising: said assembly according to claim 13; a barrel; a stock; and a firing mechanism, wherein said assembly is connected to said barrel, said stock, and said firing mechanism.

16. The firearm according to claim 15, wherein said stock comprises a receiver extension tube configured to connect to said assembly, wherein said receiver extension tube has a centerline, wherein, when said receiver extension tube is connected to said assembly, said centerline of said receiver extension tube is coaxial with said central longitudinal axis of said upper receiver.

17. The firearm according to claim 15, wherein said lower receiver comprises a polymer.

* * * * *